US006616426B1

(12) United States Patent
Liang et al.

(10) Patent No.: US 6,616,426 B1
(45) Date of Patent: Sep. 9, 2003

(54) AIRLIFT PISTON MECHANISM

(76) Inventors: Chi-Wang Liang, No. 37, Lane 229, Sec. 3, Jungshan Rd., Junghe City, Taipei (TW); Ming-Fei Chen, No. 50, Dabi Rd., Dabei Shiang, Yunlin (TW)

( * ) Notice: Subject to any disclaimer, the term of this patent is extended or adjusted under 35 U.S.C. 154(b) by 0 days.

(21) Appl. No.: 10/107,167

(22) Filed: Mar. 28, 2002

(51) Int. Cl.[7] ..... F04B 39/10; F04B 53/12
(52) U.S. Cl. ..... 417/545; 277/447; 277/464
(58) Field of Search ..... 417/545; 277/435, 277/447, 459, 464, 465, 467, 401, 408

(56) References Cited

U.S. PATENT DOCUMENTS 1,636,012 A * 7/1927 Olson et al. ..... 277/464
4,350,082 A * 9/1982 Carrens ..... 92/159
4,989,701 A * 2/1991 Yamaoka et al. ..... 188/332.17
6,200,110 B1 * 3/2001 Chou ..... 417/415
6,514,058 B1 * 2/2003 Chou ..... 417/553

* cited by examiner

*Primary Examiner*—Charles G. Freay
*Assistant Examiner*—Han L Liu
(74) *Attorney, Agent, or Firm*—Browdy and Neimark, P.L.L.C.

(57) ABSTRACT

An airlift piston mechanism is disclosed to include a casing having a piston chamber, an air inlet, a check valve in the air inlet, and an air outlet, a link, a piton reciprocated by the link in the piston chamber, the piston having an air accumulation chamber in communication with the piston chamber, annular grooves around the periphery, and an air passage in communication between the air accumulation chamber and the annular grooves, and seal rings mounted in the annular grooves, the seal rings each having radial through holes for discharging of air from the air accumulation chamber for enabling the seal rings to be lifted subject to the variation of air pressure in the air accumulation chamber to reduce friction resistance between the casing and the piston.

8 Claims, 6 Drawing Sheets

AIRLIFT PISTON MECHANISM

FIELD OF THE INVENTION

The present invention relates to a piston mechanism and, more specifically, to an airlift piston mechanism for a piston compressor.

BACKGROUND OF THE INVENTION

A conventional piston mechanism is generally comprised of a cylindrical casing defining a piston chamber, a piston mounted in the piston chamber, and a link coupling the piston to an external motor for enabling the piston to be reciprocated in the piston chamber upon operation of the external motor. In order to reduce friction between the cylindrical casing and the piston and prevent air leakage, the piston is made having two annular grooves around the periphery, and two O-rings are respectively mounted in the annular grooves and disposed in contact with the inside wall of the cylindrical casing. This arrangement still cannot greatly reduce friction between the piston and the cylindrical casing. Friction between the piston and the cylindrical casing affects the performance of the piston mechanism.

SUMMARY OF THE INVENTION

The primary object of the present invention is to provide an airlift piston mechanism, which greatly reduces friction between the cylindrical casing and the piston during reciprocating motion of the piston in the cylindrical casing.

It is another object of the present invention to provide airlift piston mechanism, which greatly improves the output efficiency of the piston.

To achieve these objects, the airlift piston mechanism is comprised of a cylindrical casing, a piston, at least one seal ring, and a link. The cylindrical casing comprises a piston chamber, an air inlet adapted for guiding outside air into the piston chamber, an air outlet adapted for guiding air from the piston chamber to the outside, and a check valve installed in the air inlet for enabling outside air to pass to the piston chamber and prohibiting inside air from escaping out of the piston chamber to the outside. The piston is axially slidably mounted in the piston chamber for reciprocating motion, comprising an air accumulation chamber, an air hole in communication between the air accumulation chamber and the piston chamber, a check valve mounted in the air hole to let air pass from the piston chamber to the air accumulation chamber and to prohibit air from escaping out of the air accumulation chamber to the piston chamber, at least one annular groove extended around the periphery thereof, and an air passage in communication between the at least one annular groove and the air accumulation chamber. The at least one seal ring is respectively mounted in the at least one annular groove of the piston, each having at least one radial through hole. The link is coupled to the piston and adapted for reciprocating the piston in the piston chamber. During reciprocating motion of the piston in the piston chamber, the seal rings are floating subject to the air pressure in the air accumulation chamber, reduction friction between the cylindrical casing and the piston.

DETAILED DESCRIPTION OF THE INVENTION

Figure 1:
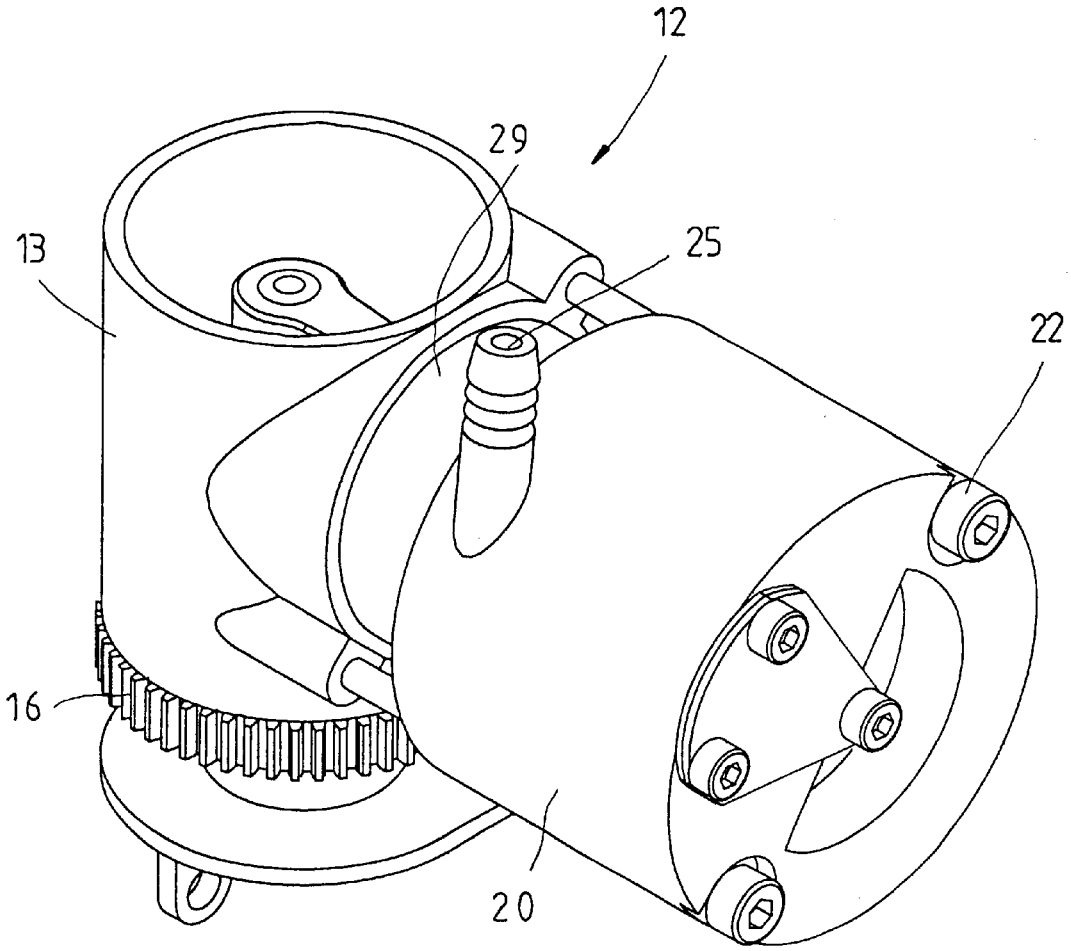
FIG. 1 is a perspective view of a preferred embodiment of the present invention, which is installed in a compressor.
Figure 2:
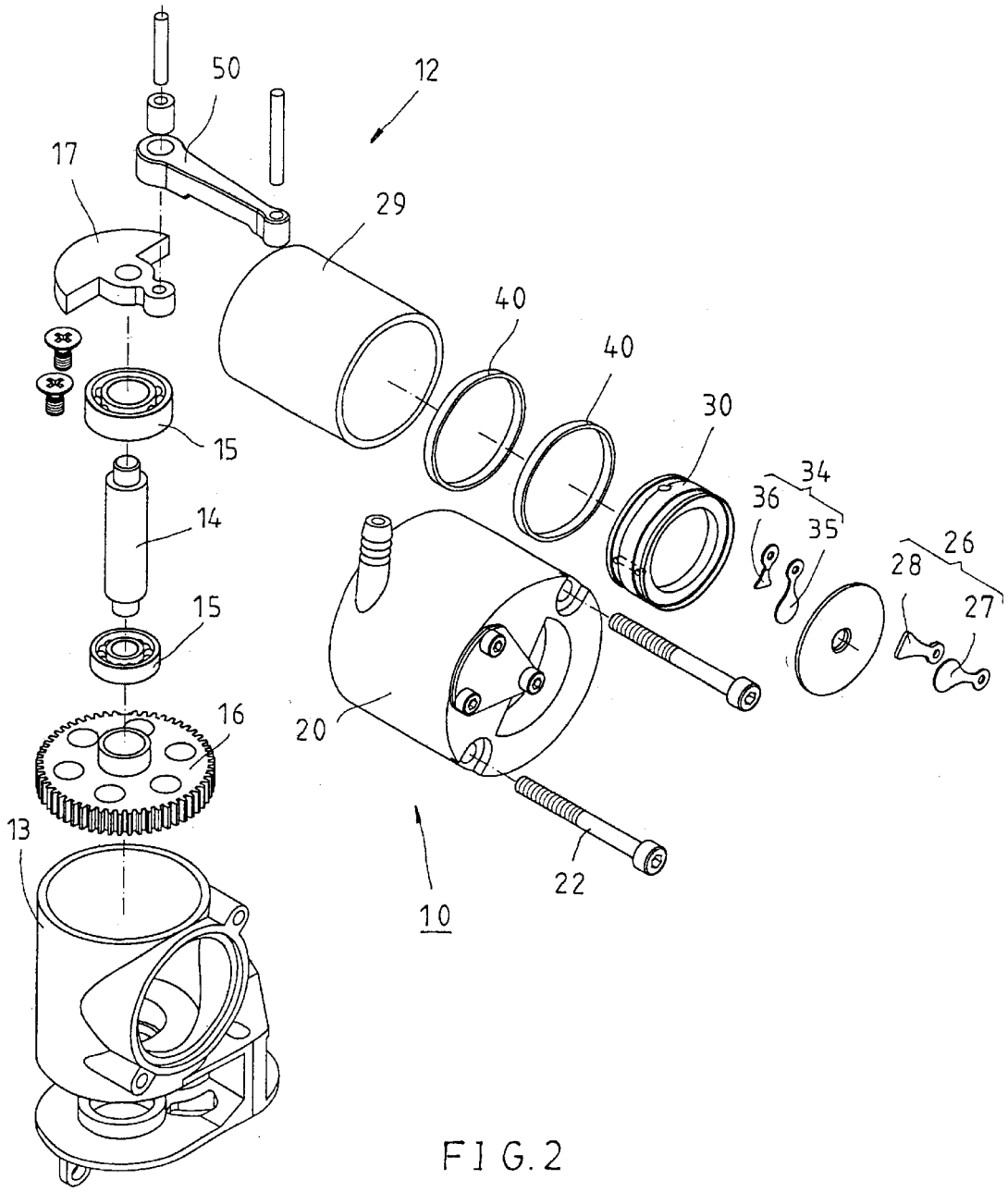
FIG. 2 is an exploded view of the preferred embodiment of the invention installed in the compressor.
Figure 3:
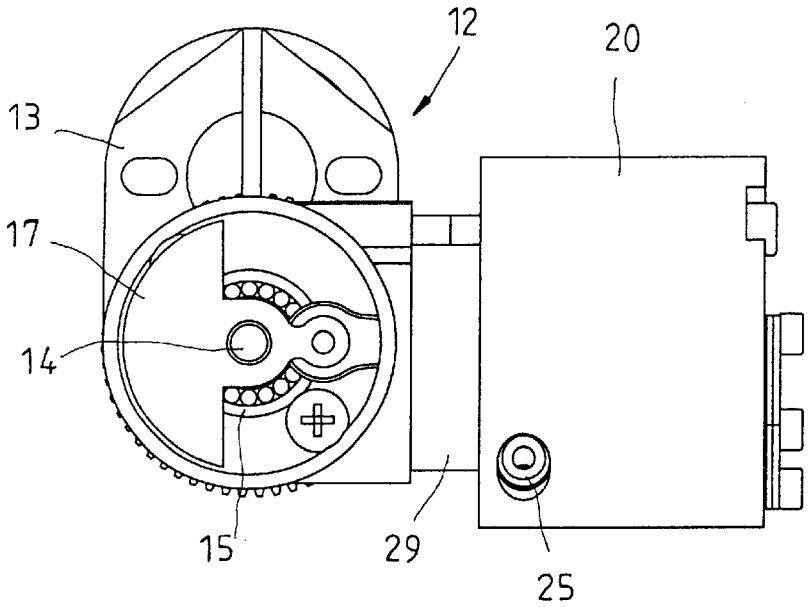
FIG. 3 is a top view of FIG. 1.
Figure 4:
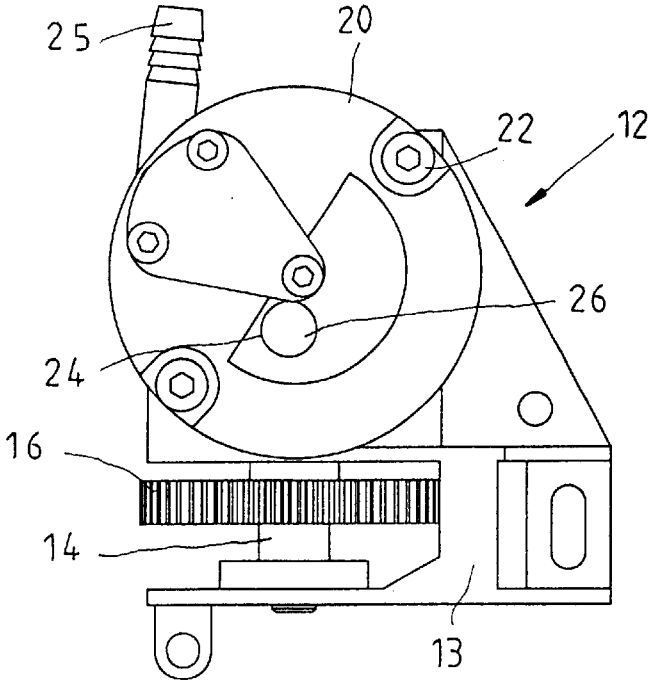
FIG. 4 is a side view of FIG. 1.
Figure 5:
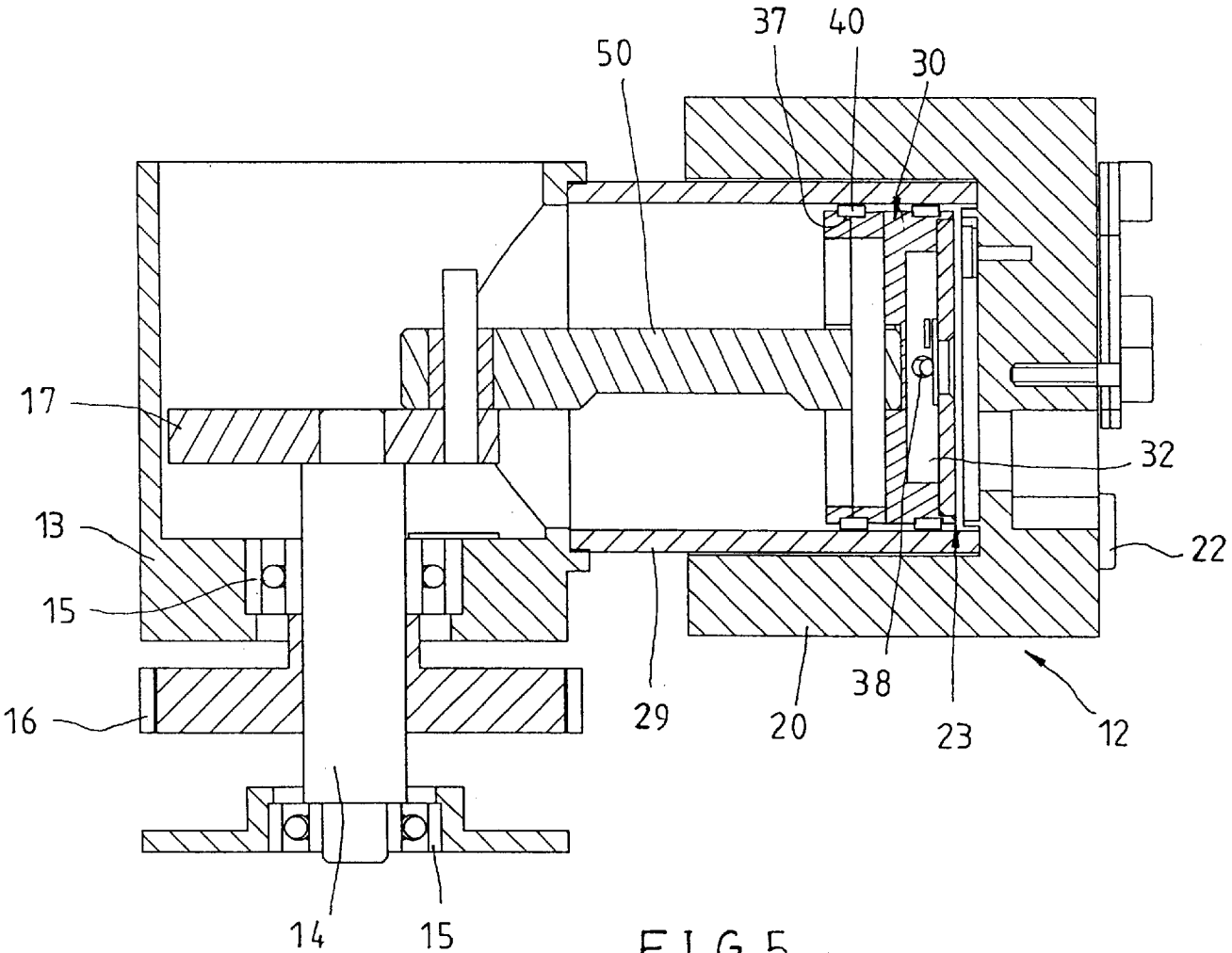
FIG. 5 is a sectional view of FIG. 1.

Referring to FIGS. from 1 through 5, an airlift piston mechanism 10 is shown installed in a piston compressor 12. The piston compressor 12 is comprised of a housing 13, a shaft 14 supported in axle bearings 15 inside the housing 13, a transmission gear 16 mounted on one end of the shaft 14, an idle wheel 17 mounted on the other end of the shaft 14, and the aforesaid airlift piston mechanism 10. The transmission gear 16 is driven by a motor (not shown) to rotate the shaft 14 and the idle wheel 17. The airlift piston mechanism 10 is comprised of a cylindrical casing 20, a piston 30, two seal rings 40, and a link 50.

The cylindrical casing 20 is fixedly fastened to the outside of the housing 13 by tie screws 22, comprising a piston chamber 23, an air inlet 24 adapted for guiding outside air into the piston chamber 23, an air outlet 25 adapted for guiding air from the piston chamber 23 to the outside, and a check valve 26 installed in the air inlet 24. The check valve 26 is comprised of a metal spring plate 27 and a stop plate 28. The metal spring plate has one end fixedly fastened to the inside wall of the cylindrical casing 20 adjacent to the inner side of the air inlet 24 so as to close the air inlet 24. The stop plate 28 has one end fixedly fastened to the inside wall of the cylindrical casing 20, and the other end spaced from the spring plate 27 at a distance. The check valve 26 enables outside air to pass to the piston chamber 23, and prohibits inside air from escaping out of the piston chamber 23 to the outside. The detailed action of the check valve 26 will be described further. In actual fabrication, a barrel 29 may be mounted in the piston chamber 23 for connection to the housing 13 conveniently. However, the installation of the barrel 29 is optional. Further, a check valve 251 is installed in the air outlet 25 to control the direction of the flowing of air from the piston chamber 23 to the outside and to prohibit outside air from passing to the piston chamber 23. The check valve 251 can easily be obtained by conventional techniques.

The piston 30 is axially slidably mounted in the piston chamber 23, comprising an air accumulation chamber 32, an air hole 33 in communication between the air accumulation chamber 32 and the piston chamber 23, a check valve 34 mounted in the air hole 33 to let air pass from the piston chamber 23 to the air accumulation chamber 32 and to prohibit air from escaping out of the air accumulation chamber 32 to the piston chamber 23, two annular grooves 37 of rectangular cross section extended around the periphery, and an air passage 38 in communication between the annular grooves 37 and the air accumulation chamber 32. Similar to the check valve 26 of the cylindrical casing 20, the check valve 34 is comprised of a spring plate 35 and a stop plate 36.

The seal rings 40 are respectively mounted in the annular grooves 37 of the piston 30, having a rectangular cross section. When installed, the top and bottom sides of the seal rings 40 are respectively disposed in contact with the annular grooves 37, and the outer and inner sides of the seal rings 40 are respectively spaced from the annular grooves 37 and the inside wall of the piston chamber 23 at a distance. Further, each seal ring 40 has six equiangularly spaced radial through holes 42.

The link 50 has one end pivoted to the piston 30, and the other end pivoted to the idle wheel 17. During rotary motion of the idle wheel 17, the link 50 transmits the rotary driving force of the idle wheel 17 to the piston 30, thereby causing the piston 30 to be reciprocated in the piston chamber 23.

Figure 6:
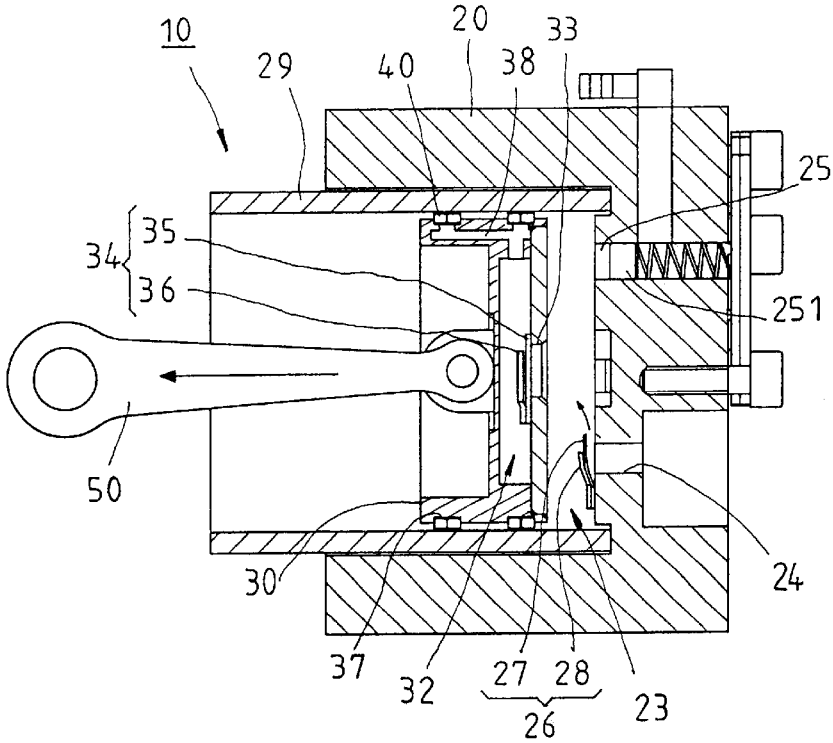
FIG. 6 is a schematic drawing showing the forward stroke of the piston in the piston chamber according to the preferred embodiment of the present invention.
Figure 7:
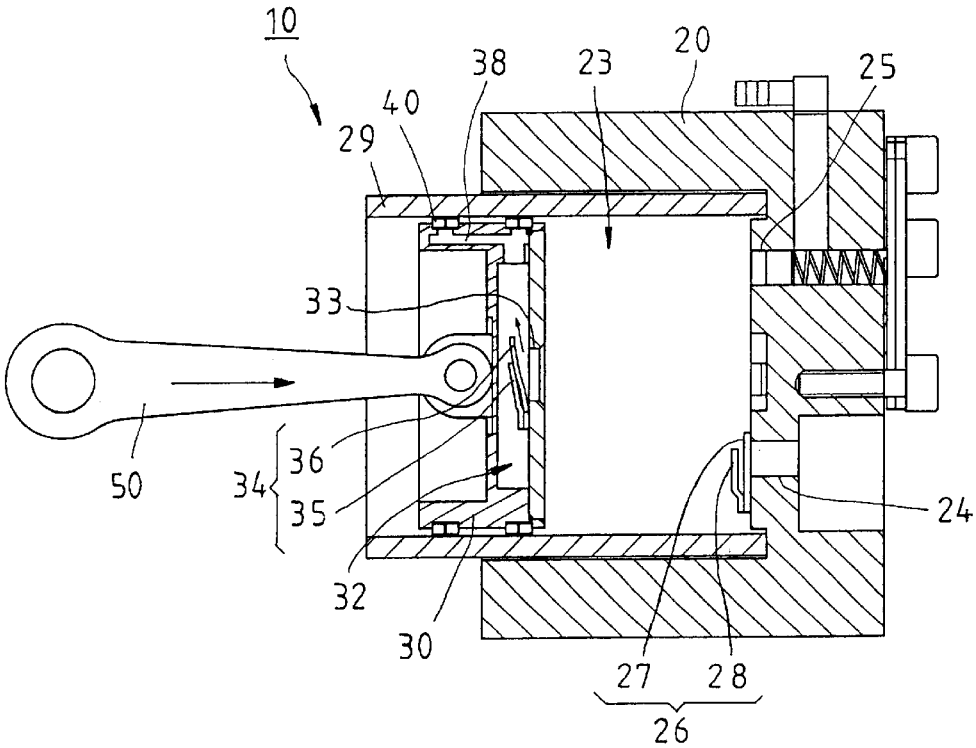
FIG. 7 is a schematic drawing showing the return stroke of the piston in the piston chamber according to the preferred embodiment of the present invention.
Figure 8:
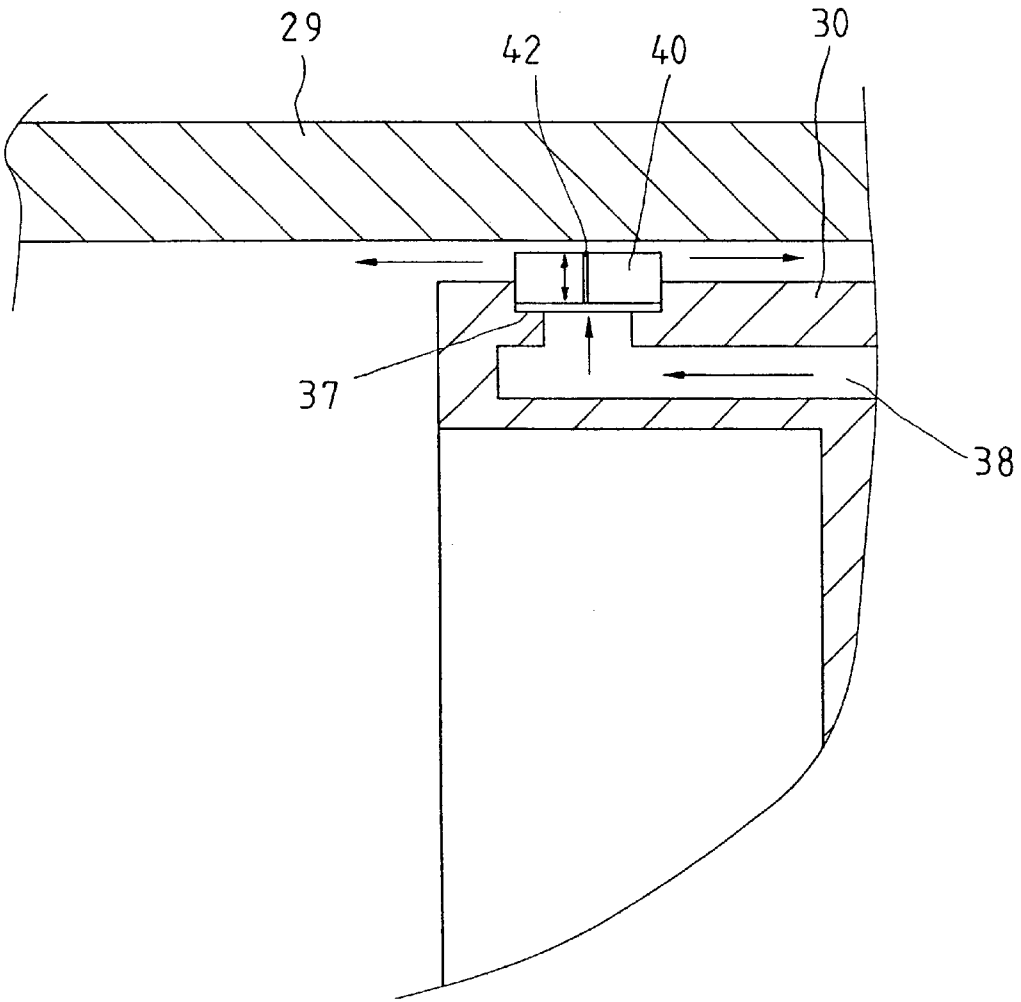
FIG. 8 is a sectional view in an enlarged scale of a part of the preferred embodiment of the present invention, showing air passed through the air passage and the radial through holes of the seal ring.

Referring to FIGS. from 6 through 8, when the link 50 pulling the piston 30 outwards from the piston chamber 23 of the cylindrical casing 20, as shown in FIG. 6, the inside air pressure of the piston chamber 23 is smaller than the outside atmospheric pressure, the spring plate 27 is deformed due to the effect of pressure difference, enabling outside air to pass through the air inlet 24 to the piston chamber 23 (see the arrowhead indication on FIG. 6). At this time, the stop plate 28 limits the extent of deformation of the spring plate 27, preventing elastic fatigue. On the contrary, when the link 50 pushing the piston 30 backwards to the inside of the piston chamber 23 of the cylindrical casing 20, as shown in FIG. 7, the inside air pressure of the piston chamber 23 is higher than the outside atmospheric pressure, and therefore the spring plate 27 is forced to close the air inlet 24. Because the inside air pressure of the piston chamber 23 is higher than the outside atmospheric pressure, the spring plate 35 is deformed, enabling air to pass from the piston chamber 23 to the air accumulation chamber 32 (see the arrowhead indication on FIG. 7). During return stroke of the piston 30 in the piston chamber 23, air is forced out of the piston chamber 32 to the annular grooves 37 via the air passage 38 and then to the outside through the radial through holes 42 of the seal rings 40 (see the arrowhead indication on FIG. 8). At this time, an airlift effect is produced between the seal rings 40 and the inside wall of the piston chamber 23 or barrel 29 to reduce friction resistance between the seal rings 40 and the piston chamber 23 or barrel 29 and to form a barrier, preventing discharging of air from the piston chamber 23. Further, when the piston 30 is being pulled outwards by the link 50 again, a certain amount of air pressure is kept in the air accumulation chamber 32 for enabling air to be continuously discharged to the outside through the air passage 38 and the radial through holes 42 of the seal rings 40. Therefore, the aforesaid airlift effect exists during forward (outward) stroke as well as backward (return) stroke of the piston 30 to greatly improve the output efficiency of the piston mechanism 20 or the piston compressor 12. Because less friction resistance is produced during reciprocating motion of the piston 30, less heat and noise are produced during the operation of the piton compressor 12, prolonging the service life of the piston compressor 12.

Furthermore, because the outer and inner sides of the seal rings 40 are respectively spaced from the annular grooves 37 and the inside wall of the piston chamber 23 at a distance, the seal rings 40 are floating between the annular grooves 37 and the inside wall of the piston chamber 23 subject to the variation of the pressure of air passing through the radial through the air passage 38 and the radial through holes 42 of the seal rings 40, i.e., the seal rings expand and contract subject to the variation of air pressure to achieve the optimum airlift effect. The diameter of the radial through holes 42 of the seal rings 40 is strictly controlled so that a small amount of air is sufficient to achieve a high volume of reduction of friction resistance.

The airlift piston mechanism of the present invention can also be employed to the fabrication of engines, air cylinders, punch presses, and etc.

What is claimed is:

1. An airlift piston mechanism comprising:

a cylindrical casing having a piston chamber, an air inlet adapted for guiding outside air into said piston chamber, an air outlet adapted for guiding air from said piston chamber to the outside, and a check valve installed in said air inlet for enabling outside air to pass to said piston chamber and prohibiting inside air from escaping out of said piston chamber to the outside;

a piston slidably mounted in said piston chamber for reciprocating motion, said piston comprising an air accumulation chamber, an air hole in communication between said air accumulation chamber and said piston chamber, a check valve mounted in said air hole to let air pass from said piston chamber to said air accumulation chamber and to prohibit air from escaping out of said air accumulation chamber to said piston chamber, at least one annular groove extended around the periphery thereof, and an air passage in communication between said at least one annular groove and said air accumulation chamber;

at least one seal ring respectively mounted in the at least one annular groove of said piston, said at least one seal ring each having at least one radial through hole; and a link coupled to said piston and adapted for reciprocating said piston in said piston chamber.

2. The airlift piston mechanism as claimed in claim 1, wherein the check valve of said cylindrical casing comprises a metal spring plate, said metal spring plate having a fixed end fixedly fastened to an inside wall of said cylindrical casing adjacent to an inner side of said air inlet for enabling said metal spring plate to close said air inlet.

3. The airlift piston mechanism as claimed in claim 2, wherein the check valve of said cylindrical casing further comprises a stop plate, said stop plate having one end fixedly fastened to said cylindrical casing on the inside and an opposite end spaced from said spring plate at a distance.

4. The airlift piston mechanism as claimed in claim 1 wherein the number of said at least one annular groove is 2.

5. The airlift piston mechanism as claimed in claim 1, wherein the check valve of said piston comprises a metal spring plate, the metal spring plate of the check valve of said piston having a fixed end fixedly fastened to said piston adjacent to an inner side of the air hole of said piston for enabling the metal spring plate of the check valve of said piston to close the air hole of said piston.

6. The airlift piston mechanism as claimed in claim 5, wherein the check valve of said piston further comprises a stop plate, the stop plate of the check valve of said piston having one end fixedly fastened to said piston and an opposite end spaced from the metal spring plate of the check valve of said piston at a distance.

7. The airlift piston mechanism as claimed in claim 1, wherein said at least one seal ring each has a rectangular cross section, top and bottom sides respectively disposed in contact with said at least one annular groove, and outer and inner sides respectively spaced from said at least one annular groove and an inside wall of said piston chamber at a distance.

8. The airlift piston mechanism as claimed in claim 1, wherein said at least one seal ring each has six radial through holes equiangularly spaced from one another.

* * * * *